US010561203B2

(12) United States Patent
McCollister

(10) Patent No.: US 10,561,203 B2
(45) Date of Patent: Feb. 18, 2020

(54) FOOTWEAR TIGHTENING DEVICE AND METHOD OF USE

(71) Applicant: Howard McCollister, Calgary (CA)

(72) Inventor: Howard McCollister, Calgary (CA)

( * ) Notice: Subject to any disclaimer, the term of this patent is extended or adjusted under 35 U.S.C. 154(b) by 105 days.

(21) Appl. No.: 15/932,270

(22) Filed: Feb. 16, 2018

(65) Prior Publication Data

US 2019/0254384 A1 Aug. 22, 2019

(51) Int. Cl.
*A43C 7/00* (2006.01)

(52) U.S. Cl.
CPC ..... *A43C 7/00* (2013.01)

(58) Field of Classification Search
CPC ..... A43C 7/00; A43C 11/165; A43C 11/1406; Y10T 24/2183; Y10T 24/3705; Y10T 24/2142; Y10T 24/3703; Y10T 24/2143; Y10T 24/216
See application file for complete search history.

(56) References Cited

U.S. PATENT DOCUMENTS 4,157,622 A 6/1979 Carlyle
5,027,482 A * 7/1991 Torppey ..... A43C 11/1493 24/306
5,333,363 A * 8/1994 Artusi ..... A43C 11/1406 24/68 SK
5,535,531 A 7/1996 Karabed et al.
5,572,777 A 11/1996 Shelton
6,327,750 B1 12/2001 Muldowney et al.
6,568,104 B2 5/2003 Liu
6,640,466 B1 11/2003 Liu
D718,064 S 11/2014 Chamberlain
2004/0078999 A1 * 4/2004 Freed ..... A43C 1/003 36/50.1
2005/0223529 A1 10/2005 McClelland
2009/0205221 A1 8/2009 Mitchell

FOREIGN PATENT DOCUMENTS

WO 2009055855 A1 5/2009
WO 2014129980 A1 8/2014

* cited by examiner

*Primary Examiner* — Robert Sandy
(74) *Attorney, Agent, or Firm* — Withrow & Terranova, PLLC

(57) ABSTRACT

A device for tightening footwear having a plurality of lace sections. The device includes a lace receiving member including a plurality of apertures therethrough. Each of the apertures are configured for receiving one of the plurality of lace sections. The lace receiving member rotates between a first orientation and a second orientation allowing the plurality of lace sections to tighten around the lace receiving member and tighten the footwear. Tightening brings paired lace holes on the footwear closer together, while loosening moves the paired lace holes farther apart.

24 Claims, 3 Drawing Sheets

FOOTWEAR TIGHTENING DEVICE AND METHOD OF USE

FIELD OF THE INVENTION

The present invention relates to footwear, and specifically to devices for tightening footwear laces.

BACKGROUND OF THE INVENTION

It is known in the art of footwear to employ a lacing system as a means to tighten and loosen a footwear article. The fastening process generally involves lace tightening followed by securing the lace in a tightened configuration, which typically involves a tied knot. The loosening process generally involves untying a lace knot followed by loosening the lace.

However, there are many people who have problems tightening and tying the laces on their footwear. Fastening and unfastening laces can be a frustrating process for many people, especially for children and the elderly.

Numerous footwear devices have been developed in an effort to provide an easy and simple means to tighten and loosen footwear laces.

For example, U.S. Pat. No. 5,572,777 to Shelton describes a shoelace tightening device which is an elongated, flat rigid plastic body with passages or holes in each end running parallel to the flat plane. The device is used by loosely threading the shoelaces through the passages and tying the ends of the shoelaces in a secure knot. The device is configured to rotate 180 degrees essentially about a transverse axis of the device thereby effectively tightening the laces by increasing the distance the laces must travel. The device contemplated by Shelton, however, is configured to rotate and pull the shoe lams in a direction parallel with the rows of eyelets on the shoe potentially causing the shoe to deform upon tightening.

United States Patent Application Publication No. 2009/0205221 A1 to Mitchell also describes a shoelace tightening device for tightening a plurality of lace sections on a shoe. The tightening device includes an elongate member having a slot for engaging with the plurality of lace sections. The device also has retaining means for rotatably retaining the elongate member and for interposing between the lace sections and the shoe. The device contemplated by Mitchell, however, suffers from drawbacks such as undue expense and complexity due to the incorporation of numerous components required to mount and suspend the device onto the plurality of lace sections.

What is needed, therefore, is a footwear tightening device or system that is relatively simple and robust in construction, while providing a means for tightening followed by securing a footwear lace in a tightened configuration.

SUMMARY OF THE INVENTION

According to a first broad aspect of the present invention, there is provided a tightening device for tightening footwear, the footwear having a plurality of lace sections, the tightening device comprising: a lace receiving member comprising a plurality of apertures therethrough each configured for receiving one of the plurality of lace sections; the lace receiving member rotatable about a longitudinal axis of the footwear between a first orientation and a second orientation; a transverse lever extending from the lace receiving member for rotating the lace receiving member between the first orientation and the second orientation; and a retention member for retaining the lace receiving member when in the second orientation; wherein the lace receiving member is configured to receive the plurality of lace sections when in the first orientation; and wherein in rotating the lace receiving member from the first orientation to the second orientation, the plurality of lace sections are tightened around the lace receiving member.

Preferably, the lace receiving member and the transverse lever are of unitary construction.

In some exemplary embodiments of the first aspect, when rotating the lace receiving member from the first orientation to the second orientation, for each of the plurality of lace sections a first portion of the lace section folds over and across a second portion of the of lace section. In other exemplary embodiments of the first aspect, when rotating the lace receiving member from the first orientation to the second orientation, the lace receiving member engages the plurality of lace sections via the plurality of apertures causing the plurality of lace sections to wrap around the lace receiving member.

In some exemplary embodiments of the first aspect, the retention member comprises a first engagement member mounted on the transverse lever. The first engagement member is configured to engage with a second engagement member mounted on the footwear allowing for retention of the lace receiving member in the second orientation.

The lace receiving member is preferably an elongated member that may be longitudinally tapered; in this case a wider portion of the elongated member allows for greater loosening of the lace sections when in the first orientation. This may be useful when positioning the wider portion of the elongated member at an area that requires greater loosening, such as the of top area of the laces. Preferably, the lace receiving member comprises a resilient material.

It is also preferable that the lace receiving member be configured to extend parallel with the length of the footwear. The plurality of apertures may be positioned longitudinally along the lace receiving member such that the position of each of the plurality of apertures preferably corresponds to the position of one of the plurality of lace holes on the footwear. The plurality of apertures comprise an entrance end and an exit end which are preferably flared outwardly.

The lace receiving member may comprise a material with a low coefficient of friction. For example, the lace receiving member may comprise Teflon.

In some exemplary embodiments of the first aspect, the lace receiving member is configured to tighten the plurality of lace sections causing a foot to be secured inside the footwear when the lace receiving member is in the second orientation. The lace receiving member is also configured to loosen the plurality of lace sections allowing a foot to be releasable from the footwear when the lace receiving member is in the first orientation.

According to a second broad aspect of the present invention, there is provided a method for tightening a plurality of lace sections on footwear, the method comprising the steps of: (a) providing a lace receiving member comprising a plurality of apertures therethrough; (b) passing each of the plurality of lace sections though one of the plurality of apertures of the lace receiving member when the lace receiving member is in a first orientation; (c) rotating the lace receiving member essentially about a longitudinal axis of the footwear between the first orientation and a second orientation causing the plurality of lace sections to tighten around the lace receiving member; and (d) retaining the lace receiving member in the second orientation.

Preferably, the lace receiving member and the transverse lever are of unitary construction.

The method may further include the step of passing each of the plurality of lace sections though at least one of a plurality of lace holes on the footwear.

In some exemplary embodiments of the second aspect, when rotating the lace receiving member from the first orientation to the second orientation, for each of the plurality of lace sections a first portion of the lace section folds over and across a second portion of the of lace section. In other exemplary embodiments of the first aspect, when rotating the lace receiving member from the first orientation to the second orientation, the lace receiving member engages the plurality of lace sections via the plurality of apertures causing the plurality of lace sections to wrap around the lace receiving member.

The method may further include the step of providing a transverse lever extending from the lace receiving member for rotating the lace receiving member between the first orientation and the second orientation. In this case, the method preferably includes the step of providing a first engagement member mounted on the transverse lever, the first engagement member configured to engage with a second engagement member mounted on the footwear allowing for retention of the lace receiving member in the second orientation.

The lace receiving member is preferably an elongated member that may be longitudinally tapered; in this case a wider portion of the elongated member allows for greater loosening of the lace sections when in the first orientation. This may be useful when positioning the wider portion of the elongated member at an area that may require greater loosening, such as the top area of the laces. Preferably, the lace receiving member comprises a resilient material.

Preferably, in the step of rotating the lace receiving member between the first orientation and the second orientation, the plurality of lace sections are tightened causing a foot to be secured inside the footwear. The method may further include the step of rotating the lace receiving member between the second orientation and the first orientation causing the plurality of lace sections to loosen allowing a foot to be releasable from the footwear. The method may further include the step of passing each of the plurality of lace sections though at least one of a plurality of lace holes on the footwear.

The method may further include the step of tying together ends of a lace member comprising the plurality of lace sections when the lace receiving member is in the second orientation, which preferably occurs when the plurality of lace sections are tightened causing a foot to be secured inside the footwear.

A detailed description of exemplary embodiments of the present invention is given in the following. It is to be understood, however, that the invention is not to be construed as being limited to these embodiments. The exemplary embodiments are directed to a particular application of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Figure 1A:
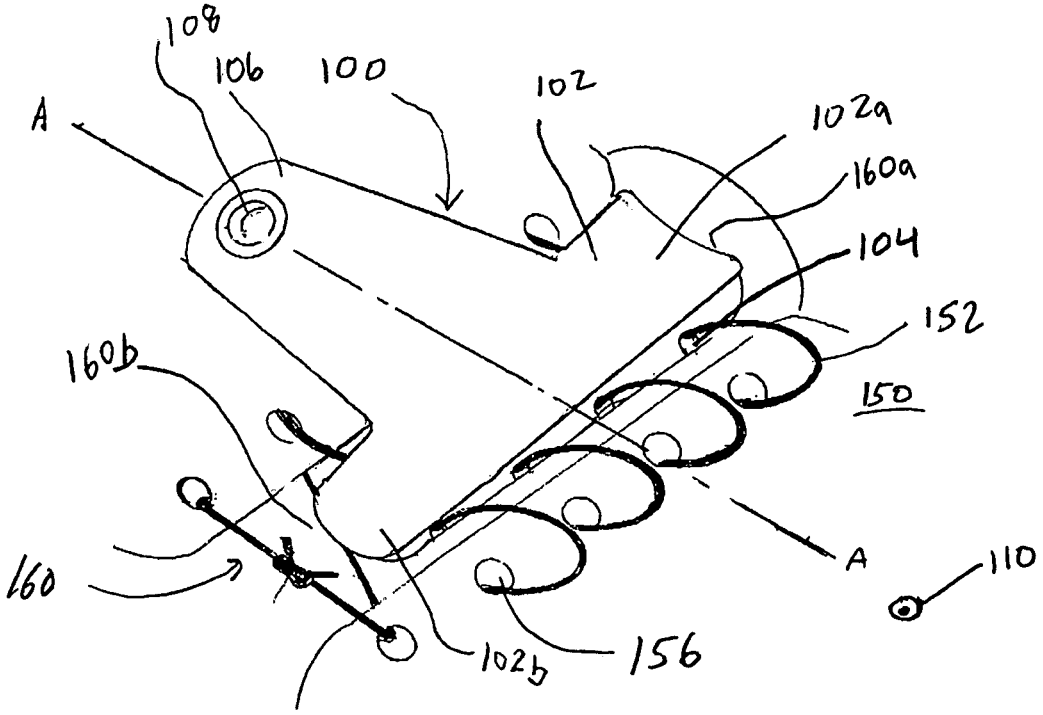
FIG. 1A is a perspective view of a first embodiment of the present invention in a first orientation engaged with a lace member of a footwear article.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description is not intended to be exhaustive or to limit the invention to the precise form of any exemplary embodiment. Accordingly, the description and drawings are to be regarded and interpreted in an illustrative, rather than a restrictive, sense.

The present invention is directed to devices for tightening footwear. The devices comprise a lace receiving member comprising a plurality of apertures therethrough. Each aperture is configured for receiving one of a plurality of lace sections.

It should be noted that for some exemplary embodiments of the present invention, that while the spacing of the plurality of holes on a footwear article may slightly differ from the spacing of the apertures on the lace receiving member, sliding of the lace or lace sections within each aperture allows the present invention to still function as lace tightening device. For such embodiments, the lace receiving member should be composed of a material with a low friction coefficient which allows for the lace and the plurality of lace sections to slide within the plurality of apertures as described herein below.

The present invention is secured onto a footwear article by passing each of a plurality of lace sections of the footwear article through one of the apertures of the lace receiving member. The lace receiving member is rotatable between a first orientation and a second orientation allowing the plurality of lace sections to tighten around the lace receiving member.

While the lace receiving member is in the first orientation, the plurality of lace sections are in a loosened configuration allowing for a foot to be inserted or removed from the footwear article.

While the lace receiving member is in the second orientation, the plurality of lace sections are in a tightened configuration allowing for a foot to be secured inside the footwear article.

Turning to FIGS. 1A to 1D, a first embodiment of the present invention is illustrated. A footwear tightening device 100 is shown that is mounted onto a footwear article 150 (partially shown) having a lace 152, comprising a plurality of lace sections 154, that is laced through a plurality of holes 156 on the footwear article 150.

The device 100 comprises a lace receiving member 102 having a plurality of apertures 104 therethrough. Each of the apertures 104 on the lace receiving member 102 receives one of the plurality of lace sections 154 of the lace 152 that is laced through the plurality of holes 156 on the footwear article 150. The lace receiving member 102 is rotatable essentially about a longitudinal axis of the footwear article 150 between a first orientation and a second orientation as described herein below.

The lace receiving member 102 is elongated such that it can be positioned longitudinally along the lacing area 160 on the footwear article 150. The position of each of the plurality of apertures 104 corresponds to the position of paired lace holes 156 positioned laterally across the top of the footwear article 150 such that the lace 152 travels from one of the paired lace holes 156, through one of the apertures 104 of the lace receiving member 102, into the other lace hole 156 of the pair.

Figure 1B:
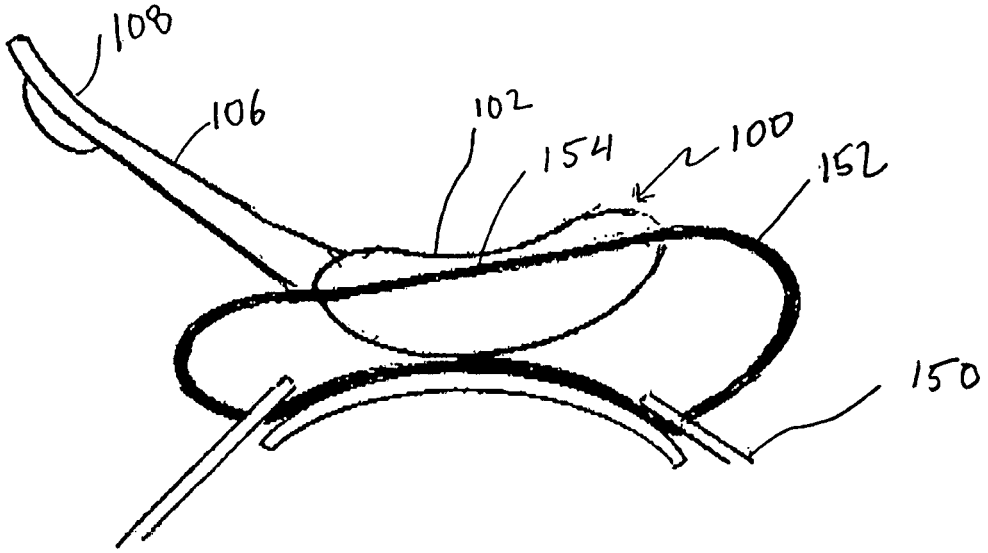
FIG. 1B is a cross-sectional view, along line A-A of FIG. 1A, of the first embodiment of the present invention in the first orientation engaged with the lace member of the footwear article.
Figure 1C:
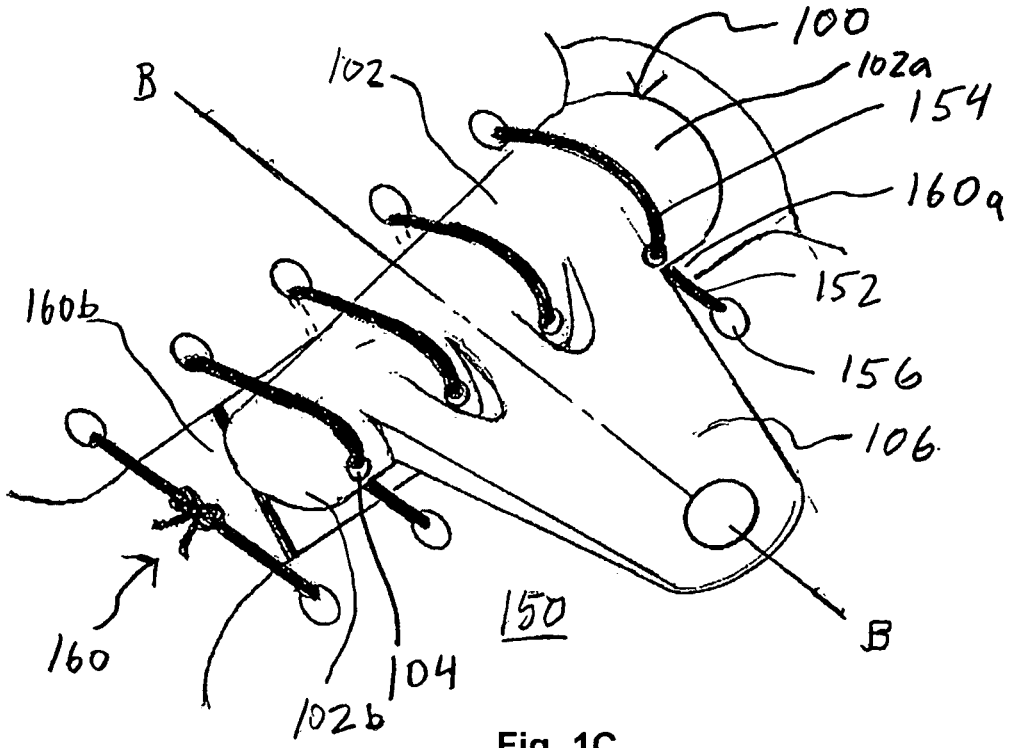
FIG. 1C is a perspective view of a first embodiment of the present invention in a second orientation engaged with the lace member of the footwear article.
Figure 1D:
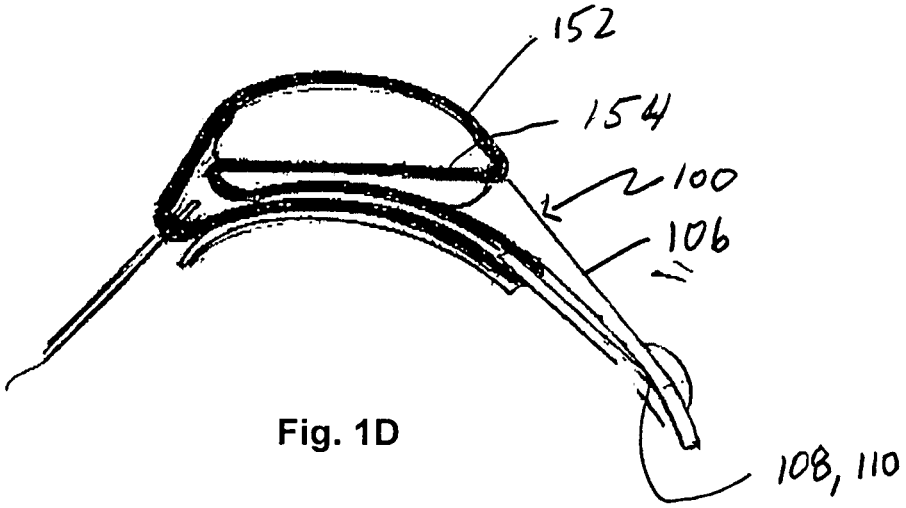
FIG. 1D is a cross-sectional view, along line B-B of FIG. 1C, of the first embodiment of the present invention in the second orientation engaged with the lace member of the footwear article.

As can be seen in FIGS. 1B and 1D, the lace receiving member 102 is concave in section allowing the lace receiving member 102 to have a more suitable fit over the area of the footwear article that has a convex shape, when in the second orientation. Those skilled in the art will be aware of numerous other shapes suitable for implementation of the present invention.

The lace receiving member 102 is also tapered and is positioned such that its wider portion 102*a* is adjacent to the top portion 160*a* of the lacing area 160 on the footwear article 150, closer to the area of the footwear article 150 where a foot is inserted. The wider portion 102*a* of the tapered lace receiving member 102 allows for greater loosening of the lace 152 at top portion 160*a* of the lacing area 160 on the footwear article 150, which is typically preferable.

A lever 106 is employed which extends from the lace receiving member 102 for rotating the lace receiving member 102 between the first orientation and the second orientation as described herein below.

It should be noted that the device 100 is preferably manufactured from a material with a low friction coefficient, such as Teflon, and the lace receiving member and the transverse lever may be of unitary construction.

The use of a material with a low friction coefficient allows for the lace 152 and the plurality of lace sections 154 to slide within the plurality of apertures 104 allowing for essentially even tension amongst the lace 152 and the plurality of lace sections 154 when the lace receiving member 102 is in the second orientation. As a material with a low friction coefficient allows for sliding of the lace 152 and the plurality of lace sections 154 within the plurality of apertures 104, the lace receiving member 102 can rotate between the first orientation and the second orientation more easily. The use of a material with a low friction coefficient may also reduce wear on the lace 152 and the plurality of lace sections 154 when rotating the lace receiving member 102 between the first orientation and the second orientation. Other suitable materials that can be used for the present invention, having a low friction coefficient, are known to those skilled in the art.

The lever 106 has a first engagement member 108 mounted onto it that is configured to releasably fasten to a second engagement member 110 mounted on the footwear article 150 when the lace receiving member 102 is in the second orientation. The first engagement member 108 and second engagement member 110 may be a snap button fastener combination or a similar fastening mechanism that allows the lace receiving member 102 to be held in the second orientation. Those skilled in the art will be aware of numerous fastener arrangements suitable for implementation of the present invention.

By rotating the lace receiving member 102 about the longitudinal axis of the footwear article 150 from the second orientation to the first orientation, the plurality of lace sections 154 unwrap around the lace receiving 102 member causing the lace 152 to loosen. The first engagement member 108 mounted on the lever 106 is unfastened from the second engagement member 110 mounted on the footwear article 150 allowing the lace receiving member 102 to be rotated to the first orientation. Rotation of the lace receiving member 102 can be achieved by rotating the lever 106 that extends from the lace receiving member 102.

FIGS. 1A and 1B illustrate the device 100 mounted onto the footwear article 150, when the lace receiving member 102 is in the first orientation. FIG. 1B provides a cross-sectional view of the device 100 along line A-A of FIG. 1A. While in the first orientation, the lace 152 is in a loosened configuration allowing for a user to insert a foot into or remove a foot from the footwear article 150.

By rotating the lace receiving member 102 essentially about a longitudinal axis of the footwear article 150 from the first orientation to the second orientation, the plurality of lace sections 154 wrap around the lace receiving member 102 causing the lace 152 to tighten. Rotation of the lace receiving member 102 can be achieved by rotating the lever 106 that extends from the lace receiving member 102.

After rotating the lace receiving member 102 to the second orientation, the first engagement member 108 mounted on the lever 106 can be releasably fastened to the second engagement member 110 mounted on the footwear article 150 allowing the lace receiving member 102 to be held in the second orientation.

In some exemplary embodiments of the present invention, each of the plurality of apertures 104 comprises a flared entrance end and exit end to minimize any wear on the plurality of lace sections 154 when wrapping around the lace receiving member 102.

FIGS. 1C and 1D illustrate the device 100 mounted onto the footwear article 150, when the lace receiving member 102 is in the second orientation. FIG. 1D provides a cross-sectional view of the device 100 along line B-B of FIG. 1C. While in the second orientation, the lace 152 is in a tightened configuration allowing for a user's foot to be secured inside the footwear article 150. It should be noted that setting the lace 152 into a tightened configuration brings paired lace holes on the footwear article 150 closer together, while setting the lace 152 into a loosened configuration moves the paired lace holes farther apart.

The wider portion 102*a* of the tapered lace receiving member 102 allows for greater tightening of the lace 152 at the top portion 160*a* of the lacing area 160 on the footwear article 150, which is typically preferable. The greater tightening of the lace 152 at the top portion 160*a*, compared to the bottom portion 160*b* of the lacing area 160, is caused by the wider portion 102*a* of the tapered lace receiving member 102 effectively increasing the distance the lace 152 must travel as the lace receiving member 102 engages with the lace 152 in the second orientation.

It should also be noted that while the illustrated embodiment is one footwear tightening device mounted on a footwear article, the present invention could be implemented in longitudinal arrangement wherein multiple footwear tightening devices are mounted in series on a footwear article. The footwear tightening devices can be joined by linkages or other means known to those skilled in the art. An arrangement having multiple footwear tightening devices may be useful for footwear articles having a long lacing area, such as a boot. Those skilled in the art will be aware of numerous arrangements suitable for implementation of the present invention.

Figure 2:
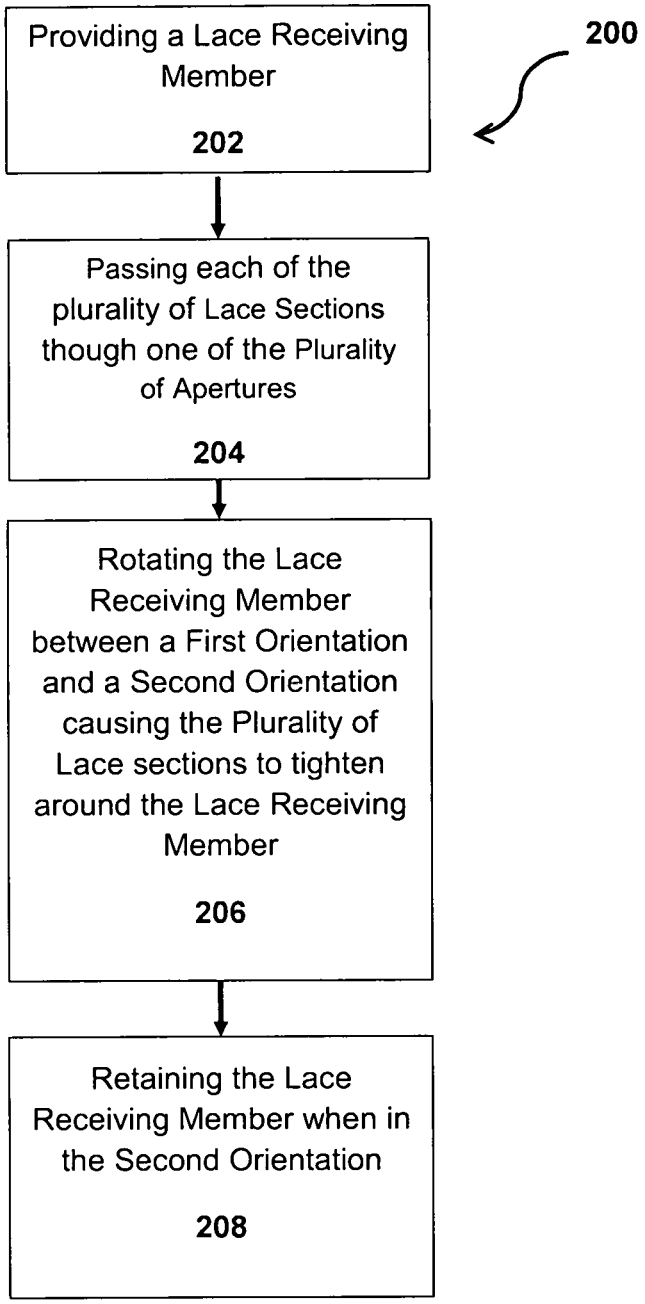
FIG. 2 is a flow chart illustrating a second exemplary embodiment.

Turning to FIG. 2, a second embodiment of the present invention is illustrated. A non-limiting exemplary method 200 is illustrated in the flowchart and described herein that allows for tightening a plurality of lace sections by using a device akin to that described with respect to the first embodiment of the present invention.

The first step 202 involves providing a lace receiving member 102 having a plurality of apertures 104 therethrough.

Each of a plurality of lace sections are passed through one of the plurality of apertures of the lace receiving member when the lace receiving member is in a first orientation at step 204, as described above herein. This step may also involve passing each of the plurality of lace sections though at least one of a plurality of lace holes on a footwear article. In some exemplary embodiments of the present invention, the method may further include the step of tying together ends of the lace comprising the plurality of lace sections. This preferably occurs when the lace receiving member is in the second orientation and the plurality of lace sections are tightened such that a foot can be secured inside the footwear article.

In some exemplary embodiments of the present invention, passing each of the plurality of lace sections though at least one of a plurality of lace holes on a footwear article commences at the top portion of the lacing area on the footwear article and ends of the lace, comprising the plurality of lace sections, are tied in a knot at the bottom portion of the lacing area when the lace receiving member is in the second orientation (as shown in FIGS. 1C and 1D).

The next step 206 involves rotating the lace receiving member essentially about a longitudinal axis of the footwear article from the first orientation to a second orientation thereby causing the plurality of lace sections to wrap and tighten around the lace receiving member. Rotation of the lace receiving member may be achieved rotating a lever that extends from the lace receiving member.

The lace receiving member, when in the second orientation, is then retained at step 208. This may involve the further step of providing a first engagement member mounted on the lever that releasably fastens to a second engagement member mounted on the footwear article as described for the first embodiment.

While the above description is with respect to a method for tightening of a plurality of lace sections, it will be clear to those skilled in the art that the present invention may be directed to a method for loosening a plurality of lace sections.

For example, in some exemplary embodiments of the present invention, the first engagement member mounted on the lever can be unfastened from the second engagement member mounted on the footwear article allowing the lace receiving member to be rotated to the first orientation. Rotation of the lace receiving member can then be achieved by rotating the lever that extends from the lace receiving member. By rotating the lace receiving member about the longitudinal axis of the footwear article from the second orientation to the first orientation, the plurality of lace sections unwrap around the lace receiving member causing the plurality of lace sections to loosen.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The invention provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

What is claimed is:

1. A tightening device for tightening footwear, the footwear having a plurality of lace sections, the tightening device comprising:

a lace receiving member comprising a plurality of apertures therethrough each configured for receiving one of the plurality of lace sections;

the lace receiving member rotatable about a longitudinal axis of the footwear between a first orientation and a second orientation;

a transverse lever extending from the lace receiving member for rotating the lace receiving member between the first orientation and the second orientation; and a retention member for retaining the lace receiving member when in the second orientation;

wherein the lace receiving member is configured to receive the plurality of lace sections when in the first orientation; and wherein in rotating the lace receiving member from the first orientation to the second orientation, the plurality of lace sections are tightened around the lace receiving member.

2. The device of claim 1 wherein in rotating the lace receiving member from the first orientation to the second orientation, for each of the plurality of lace sections a first portion of the lace section folds over and across a second portion of the of lace section.

3. The device of claim 1 wherein in rotating the lace receiving member from the first orientation to the second orientation, the lace receiving member engages the plurality of lace sections via the plurality of apertures causing the plurality of lace sections to wrap around the lace receiving member.

4. The device of claim 1 wherein the retention member comprises a first engagement member mounted on the transverse lever, the first engagement member configured to engage with a second engagement member mounted on the footwear allowing for retention of the lace receiving member in the second orientation.

5. The device of claim 1 wherein the lace receiving member is an elongated member.

6. The device of claim 5 wherein the lace receiving member is longitudinally tapered.

7. The device of claim 5 wherein the lace receiving member is configured to extend parallel with the length of the footwear.

8. The device of claim 5 wherein the plurality of apertures are positioned longitudinally along the lace receiving member.

9. The device of claim 5 wherein the plurality of apertures comprise an entrance end and an exit end, the entrance end and exit end are flared outwardly.

10. The device of claim 1 wherein the lace receiving member and the transverse lever are of unitary construction.

11. The device of claim 1 wherein the lace receiving member comprises a resilient material.

12. The device of claim 1 wherein the lace receiving member comprises a material with a low coefficient of friction allowing for the plurality of lace sections to slide within the plurality of apertures.

13. The device of claim 1 wherein the lace receiving member comprises Teflon.

14. The device of claim 1 wherein the position of each of the plurality of apertures corresponds to the position of one of a plurality of lace holes on the footwear.

15. The device of claim 1 wherein the lace receiving member is configured to tighten the plurality of lace sections causing a foot to be secured inside the footwear when the lace receiving member is in the second orientation; and wherein the lace receiving member is configured to loosen the plurality of lace sections allowing a foot to be releasable from the footwear when the lace receiving member is in the first orientation.

16. A method for tightening a plurality of lace sections on footwear, the method comprising the steps of:

a. providing a lace receiving member comprising a plurality of apertures therethrough;

b. passing each of the plurality of lace sections though one of the plurality of apertures of the lace receiving member when the lace receiving member is in a first orientation;

c. rotating the lace receiving member essentially about a longitudinal axis of the footwear between the first orientation and a second orientation causing the plurality of lace sections to tighten around the lace receiving member; and d. retaining the lace receiving member in the second orientation, wherein in rotating the lace receiving member from the first orientation to the second orientation, for each of the plurality of lace sections a first portion of the lace section folds over and across a second portion of the of lace section.

17. The method of claim 16 wherein in rotating the lace receiving member from the first orientation to the second orientation, the lace receiving member engages the plurality of lace sections via the plurality of apertures causing the plurality of lace sections to wrap around the lace receiving member.

18. The method of claim 16 further comprising the step of providing a transverse lever extending from the lace receiving member for rotating the lace receiving member between the first orientation and the second orientation.

19. The method of claim 18 further comprising the step of providing a first engagement member mounted on the transverse lever, the first engagement member configured to engage with a second engagement member mounted on the footwear allowing for retention of the lace receiving member in the second orientation.

20. The method of claim 16 wherein in the step of rotating the lace receiving member between the first orientation and the second orientation, the plurality of lace sections are tightened causing a foot to be secured inside the footwear.

21. The method of claim 16 further comprising the step of rotating the lace receiving member between the second orientation and the first orientation causing the plurality of lace sections to loosen allowing a foot to be releasable from the footwear.

22. The method of claim 16 further comprising at step b., passing each of the plurality of lace sections though at least one of a plurality of lace holes on the footwear.

23. The method of claim 16 further comprising after step c. or d., the step of tying together ends of a lace member comprising the plurality of lace sections.

24. The method of claim 23 wherein the step of tying together ends of the lace member occurs when the plurality of lace sections are tightened causing a foot to be secured inside the footwear.

* * * * *